US011945639B2

(12) United States Patent
Kuo

(10) Patent No.: US 11,945,639 B2
(45) Date of Patent: Apr. 2, 2024

(54) CONTAINER STRUCTURE

(71) Applicant: PONOPACK CO., LTD., Taoyuan (TW)

(72) Inventor: Peng-Yi Kuo, Taoyuan (TW)

(73) Assignee: PONOPACK CO., LTD., Taoyuan (TW)

( * ) Notice: Subject to any disclaimer, the term of this patent is extended or adjusted under 35 U.S.C. 154(b) by 156 days.

(21) Appl. No.: 17/730,239

(22) Filed: Apr. 27, 2022

(65) Prior Publication Data

US 2023/0085496 A1 Mar. 16, 2023

(30) Foreign Application Priority Data

Sep. 10, 2021 (TW) ..... 110210800
Feb. 18, 2022 (TW) ..... 111201747

(51) Int. Cl.
*B65D 81/34* (2006.01)
*B65D 75/32* (2006.01)

(52) U.S. Cl.
CPC ..... *B65D 81/3453* (2013.01); *B65D 75/326* (2013.01); *B65D 2575/3227* (2013.01); *B65D 2581/344* (2013.01); *B65D 2581/3445* (2013.01); *B65D 2581/3477* (2013.01); *B65D 2581/3479* (2013.01); *B65D 2581/3483* (2013.01); *B65D 2581/3494* (2013.01)

(58) Field of Classification Search
CPC ..... B65D 81/3453; B65D 81/3446; B65D 81/34; B65D 75/326; B65D 75/325; B65D 75/32; B65D 75/30; B65D 75/28; B65D 75/26; B65D 2575/3227; B65D 2575/3218; B65D 2575/3209; B65D 2575/32; B65D 2575/30; B65D 2575/28; B65D 2575/00
See application file for complete search history.

(56) References Cited

U.S. PATENT DOCUMENTS

2003/0010778 A1* 1/2003 Kim ..... B65D 81/3453 219/734
2008/0063759 A1* 3/2008 Raymond ..... B65D 81/3453 426/106
2009/0155419 A1* 6/2009 Gan ..... A21D 10/02 426/62
2014/0348989 A1* 11/2014 Sloat ..... A23L 5/13 219/731
2021/0061540 A1* 3/2021 Harrison ..... A47G 19/00

* cited by examiner

*Primary Examiner* — Javier A Pagan

(57) ABSTRACT

A container structure for sealing and keeping food fresh, which can be repacked after unpacking. The container structure has a container body and a covering film; the container body has a housing chamber, a first abutting face, a concave groove portion, a second abutting face and a preset break line; the covering film can seal the housing chamber and bond with the first and second abutting face, specifically, it is bonded to the first abutting face through the micro sealing portion, so that the bonding between the covering film and the first abutting face is weaker than the bonding between the second abutting face; To open the covering film, the user needs to apply a force upon the external edge of the top end of the container body, to break the preset break line, and to separate the covering film from the first abutting face, so as to form a separated and independent frame.

10 Claims, 15 Drawing Sheets

CONTAINER STRUCTURE

BACKGROUND OF INVENTION

1. Field of the Invention

The present invention relates generally to a container for food, and more particularly to a food container which can be used to heat food in the microwave.

2. Description of Related Art

Nowadays, convenience stores and supermarkets are selling various kinds of food. To facilitate display and carrying, the food is contained in a container, and the container is covered by a transparent film or a plastic cover for hygiene and safety, as well as clear demonstration.

In the case of a conventional container, once the covering film is torn open, it cannot be recovered, or, after the plastic cover is removed, it may be damaged or polluted and can no longer be used to cover the container. Therefore, it would be best if the consumer eat all the food at once. If there is some food left, the food and the container will have to be discarded because it is inconvenient to keep the food well-packed.

In view of this, the present invention aims to develop a container structure to contain food, which, after unpacking, can be repacked in a secure manner, so as to avoid pollution.

SUMMARY OF THE INVENTION

The purpose of the present invention is to provide a container structure that provides both sealing and preservation of freshness.

In order to solve the above problems and achieve the purpose of the present invention, the technical means of the present invention are as follows.

A container structure, comprising a container body and a covering film; wherein the container body is a plastic box, having a housing chamber that includes at least one housing space, a top end of the periphery of the housing chamber protrudes outward to form a first abutting face, the first abutting face protrudes outward to form a concave groove portion, a top end of a periphery of the concave groove portion further protrudes outward to form a second abutting face; the first abutting face and the second abutting face both surround the housing chamber, with a concave groove portion in between, forming a frame of the container body; the first abutting face is like an inner ring of the frame, and the second abutting face is like an outer ring of the frame; an inner bottom of the concave groove portion has a preset break line configured along the concave groove portion, the preset break line is a tear line that can break under an external force, and is configured in a ring, on the other side of the concave groove portion, a notch portion without a tear line is configured;

wherein the covering film is a heat-sealing film that covers the housing chamber of the container body, its bottom face is bonded to the first abutting face and the second abutting face through heat sealing, and does not contact the concave groove portion; the covering film is bonded to the second abutting face to face, and bonded to the first abutting face through dotted sealing, forming an array of micro sealing portion, so that a plurality of dotted micro imprints arranged in an array appear on the surface of the covering film; after completion of the heat sealing, the dotted bonding between the covering film and the first abutting face is weaker than the facial bonding between the covering film and the second abutting face; to open the covering film, the user needs to apply a pulling force upon the external edge of the top end of the container body, to break the preset break line inside the concave groove portion, then pull the covering film upward, to separate the micro imprints, so that the covering film is separated from the first abutting face, while still bonded with the second abutting face, at this point, part of the concave groove portion and the second abutting face will form a separated and independent ring-shaped frame; in addition, the notch portion is formed with a connecting portion that enables pivoted rotation of the frame, as the covering film is always bonded with the second abutting face, a covering plate is maintained on the frame to open and close the housing chamber at any time.

More particularly, wherein, the side of the concave groove portion other than the side of the notch portion is protruded with an outward protruding portion; the position of the preset break line corresponding to the outward protruding portion is correspondingly formed with an outward protruding section, after breaking of the outward protruding section, a snap plate is correspondingly formed at the concave groove portion, the snap plate can be used as the outward protruding portion to lock the frame.

More particularly, wherein, on the vertical wall of the concave groove portion adjacent to the first abutting face, a ring-shaped enhancing rib is provided in a protruding form.

More particularly, wherein, the periphery on the side of the second abutting face other than the side of the notch portion is protruded with a pull plate.

More particularly, wherein the cap height of the first abutting face is higher than the cap height of the second abutting face.

More particularly, wherein the cap height of the first abutting face is equal to the cap height of the second abutting face.

More particularly, wherein the vertical peripheral wall inside the housing chamber of the container body is configured with concave or convex enhancing portions.

More particularly, wherein the covering film is preferably made of Cast Polypropylene (CPP).

More particularly, wherein the container body is a plastic container produced through vacuum forming or injection forming.

More particularly, wherein the container body is a plastic container produced through injection forming.

Comparing to the prior art, the present invention has the following efficacy: The present invention combines a container body with a covering film. After removing the covering film, a covering plate will be formed. The covering plate can repeatedly open and close the container body. The covering plate and the container body are partly connected to each other, and will not fall apart completely, just like the container body has an integral covering plate. With the present invention, the hygiene and safety of the food inside the container can be guaranteed. The food can be sealed and kept fresh, and can be covered again after unpacking. The covering plate will not be damaged or contaminated. Consumers can easily keep and carry the food while avoiding food contamination.

In the present invention, after the preset break line is broken, part of the concave groove portion and the second abutting face forms a ring-shaped frame. The frame combines with the covering film to form a covering plate. Moreover, through the coordination between the outward protruding portion and the outward protruding section, a snap plate is formed after breakage of the preset break line.

When the covering plate is covered again, the snap plate can be firmly attached the frame, and cannot be opened easily.

In the present invention, through the formation of the micro sealing portion, the dotted bonding between the covering film and the first abutting face is weaker than the facial bonding between the covering film and the second abutting face. Therefore, the covering film can be easily removed from the first abutting face. While providing good sealing, it can be easily and completely peeled off. Moreover, it can be easily manufactured.

DETAILED DESCRIPTION OF THE INVENTION

Figure 1:
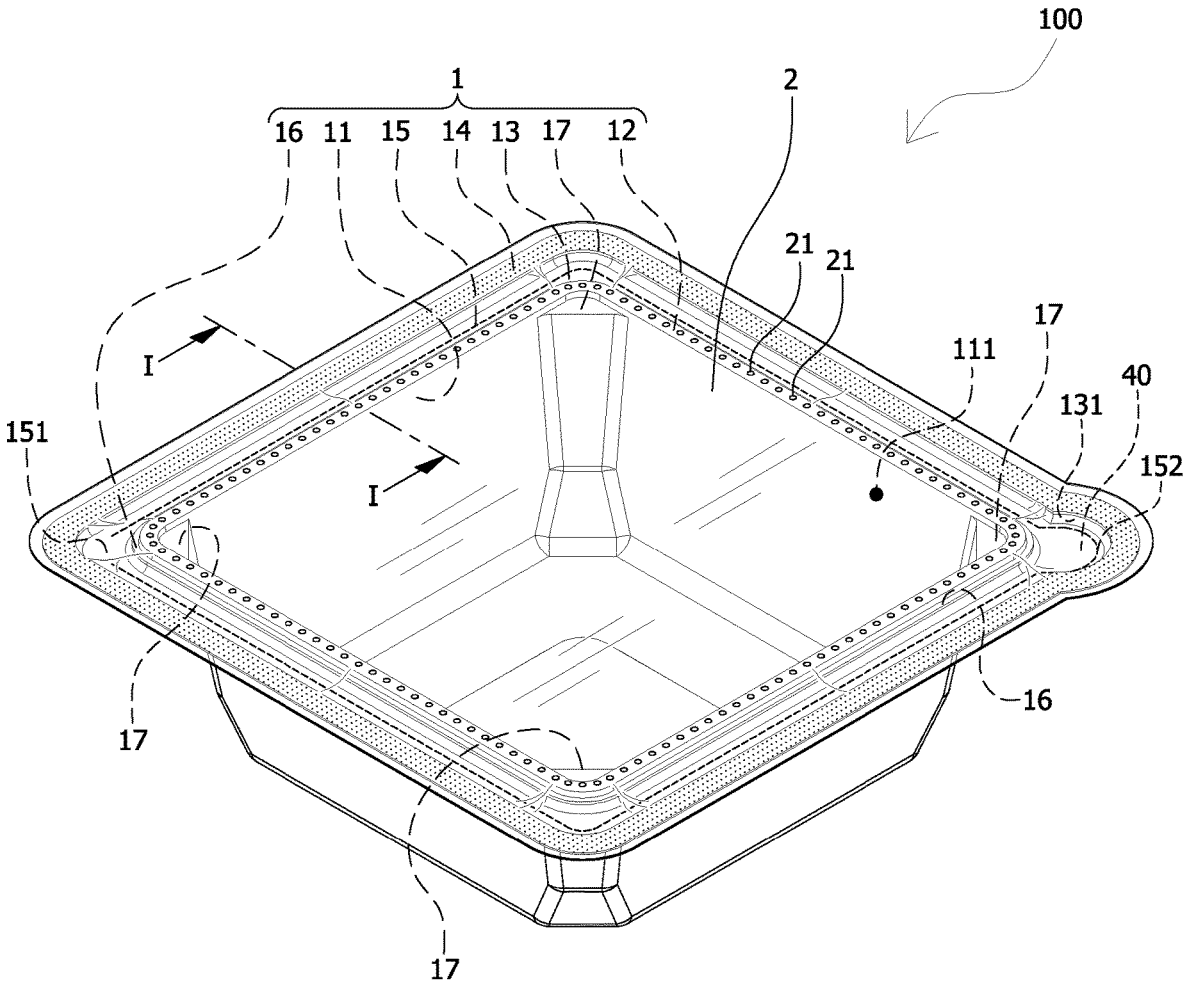
FIG. 1 is a perspective view of the invention.

Referring to FIGS. 1 to 6 for a container structure 100, which comprises a container body 1 and a covering film 2, having the following structures:

The container body 1 is a plastic box, comprising a housing chamber 11 having at least one housing space 111. The top end of the periphery of the housing chamber 11 is protruded outward to form a first abutting face 12. The first abutting face 12 is protrudes outward to form a concave groove portion 13. The top end of the periphery of the concave groove portion 13 is further protruded outward to form a second abutting face 14; the first abutting face 12 and the second abutting face 14 circularly surround the housing chamber 11, with a concave groove portion 13 in between, forming the peripheral frame of the container body 1; furthermore, the first abutting face 12 is like the inner ring of the frame, whereas the second abutting face 14 is like the outer ring of the frame; furthermore, the bottom side of the concave groove portion 13 is configured with a preset break line 15 along the concave groove portion 13. The preset break line 15 is a tear line that can break easily under an external force, and is configured in a ring. One side of the concave groove portion 13 is configured with a notch portion 151 without a tear line. The tear line is die-pressed using a die cutter.

The container body 1 can be manufactured through vacuum forming or injection forming. The manufacturing method is usually determined by the requirements and costs. For example, vacuum forming is suitable for low-cost disposable products, whereas injection forming is suitable for non-disposable products with higher prices.

The covering film 2 is a heat-sealing film that can cover the housing chamber 11 of the container body 1. Its bottom face is heat sealed on the first abutting face 12 and the second abutting face 14 and does not contact the concave groove portion 13; the covering film 12 and the second abutting face 14 are sealed face to face, whereas the first abutting face 12 uses dotted sealing to form a micro sealing portion 21 in the form of a straight array, so that an array of dotted micro imprints 211 appears on the surface of the covering film 2; after the above heat sealing, the bonding of the dotted sealing between the covering film 2 and the first abutting face 12 is weaker than the bonding of facial sealing between the covering film 2 and the second abutting face 14. Therefore, when the covering film 2 is pulled by an external force, it can easily fall apart the first abutting face 12, but may not easily fall apart the second abutting face 14.

Furthermore, the aforethe covering film 2 is made of Polypropylene, and more specifically a Cast Polypropylene film (CPP film). This material is not stretchable, but its surface can have different properties, such as various colors, cloudy surface, glossy surface, anti-fogging surface, printing etc. If the covering film 2 is made of transparent CPP films, the user can directly see the food inside the container body 1; through this covering film 2, the micro sealing portion 21 can be easily formed. Manufacturers do not need to spend too much additional cost in production. Therefore, the present invention can be easily manufactured and can provide convenience to advertising.

By combining the aforethe container body 1 and covering film 2 to form the container structure 100 of the present invention, good safety, hygiene and sealing can be guaranteed. Food can be held inside the housing space 111 of the housing chamber 11. The covering film 2 can keep the food well-sealed and fresh. The container can be closed again after unpacking. Thus, consumers can easily keep and carry the unfinished food.

Figure 2:
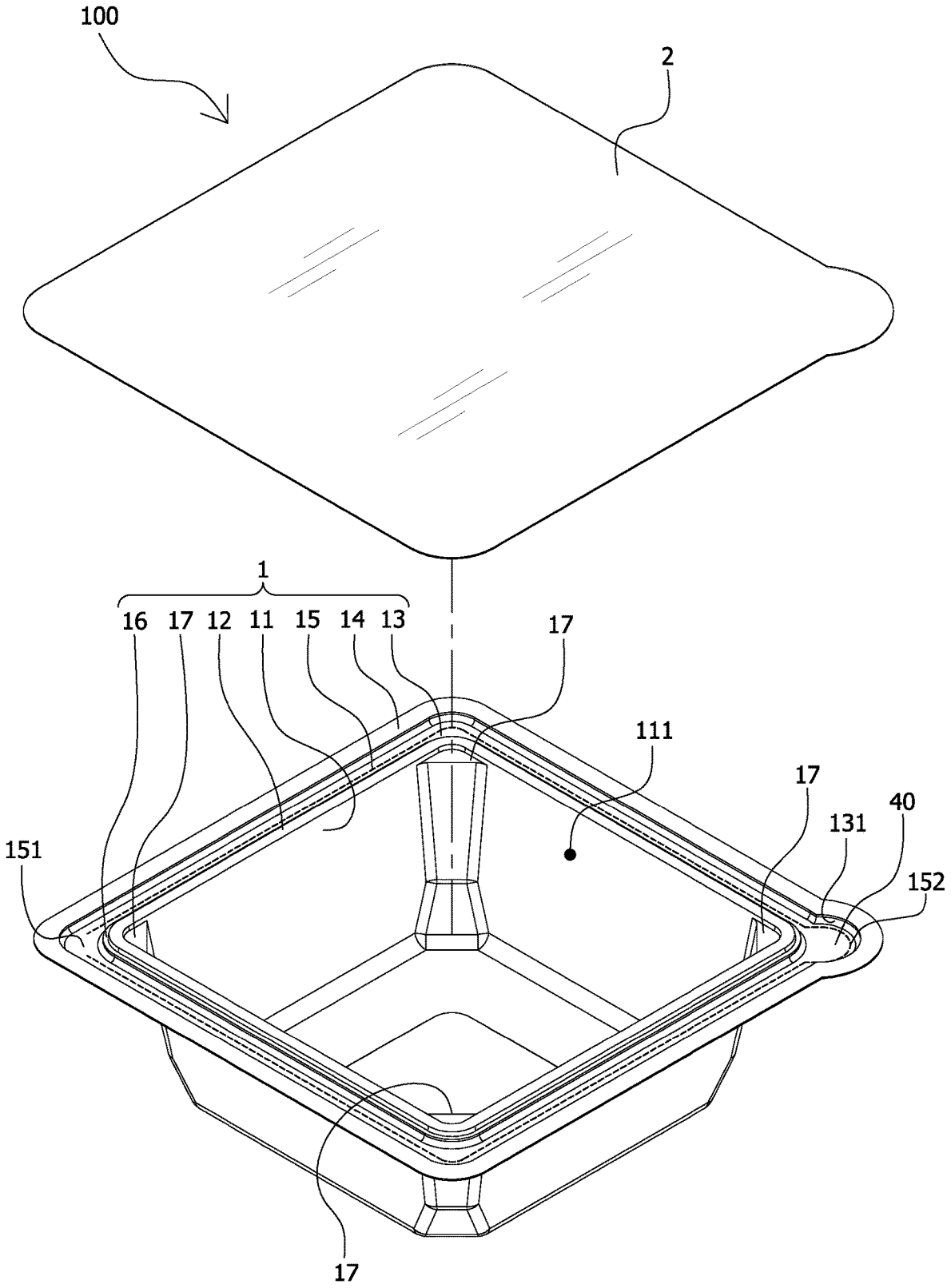
FIG. 2 is an exploded perspective view of the container structure in FIG. 1.
Figure 3:
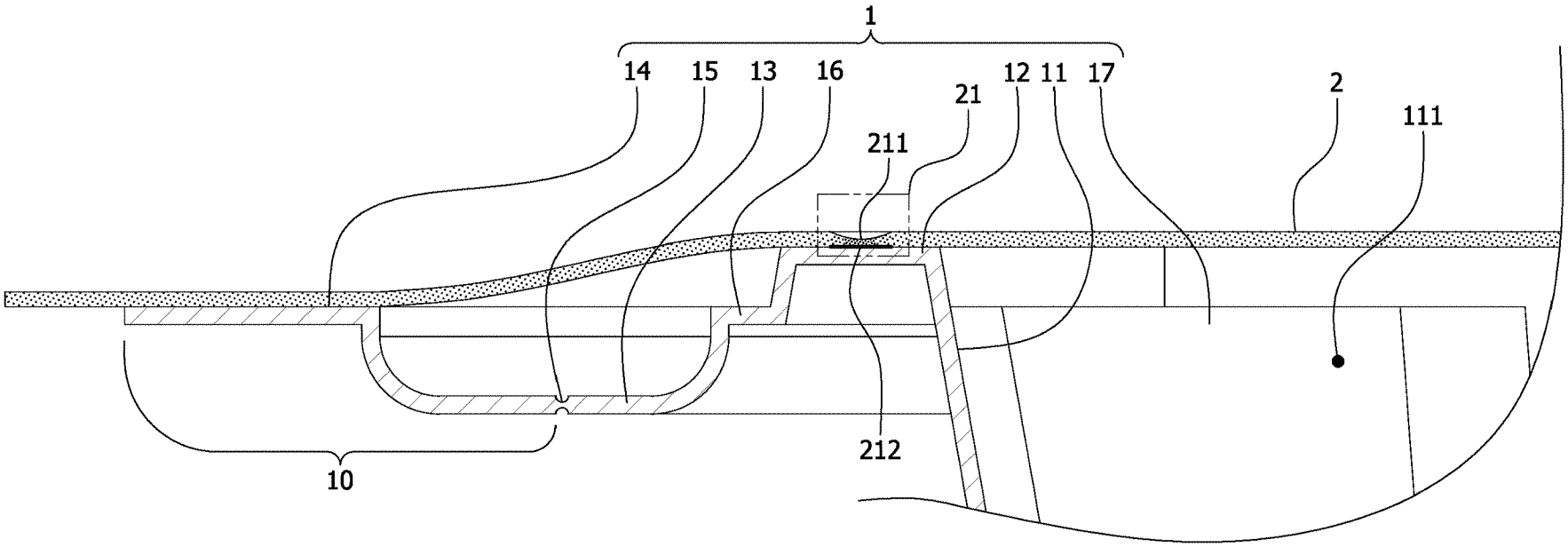
FIG. 3 is a I-I sectional view of FIG. 1.
Figure 4:
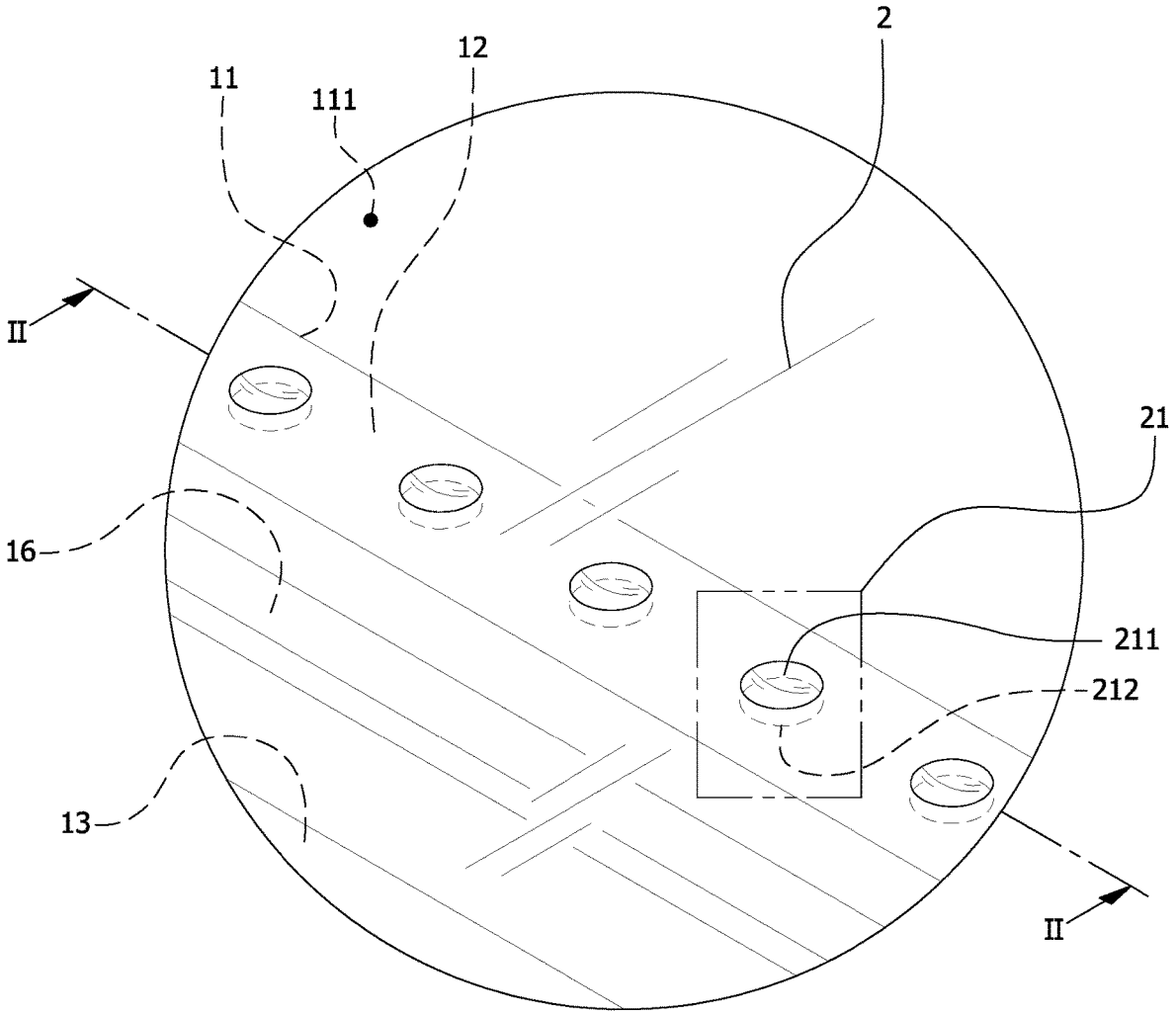
FIG. 4 is an enlarged perspective view of the micro sealing portion.
Figure 5:
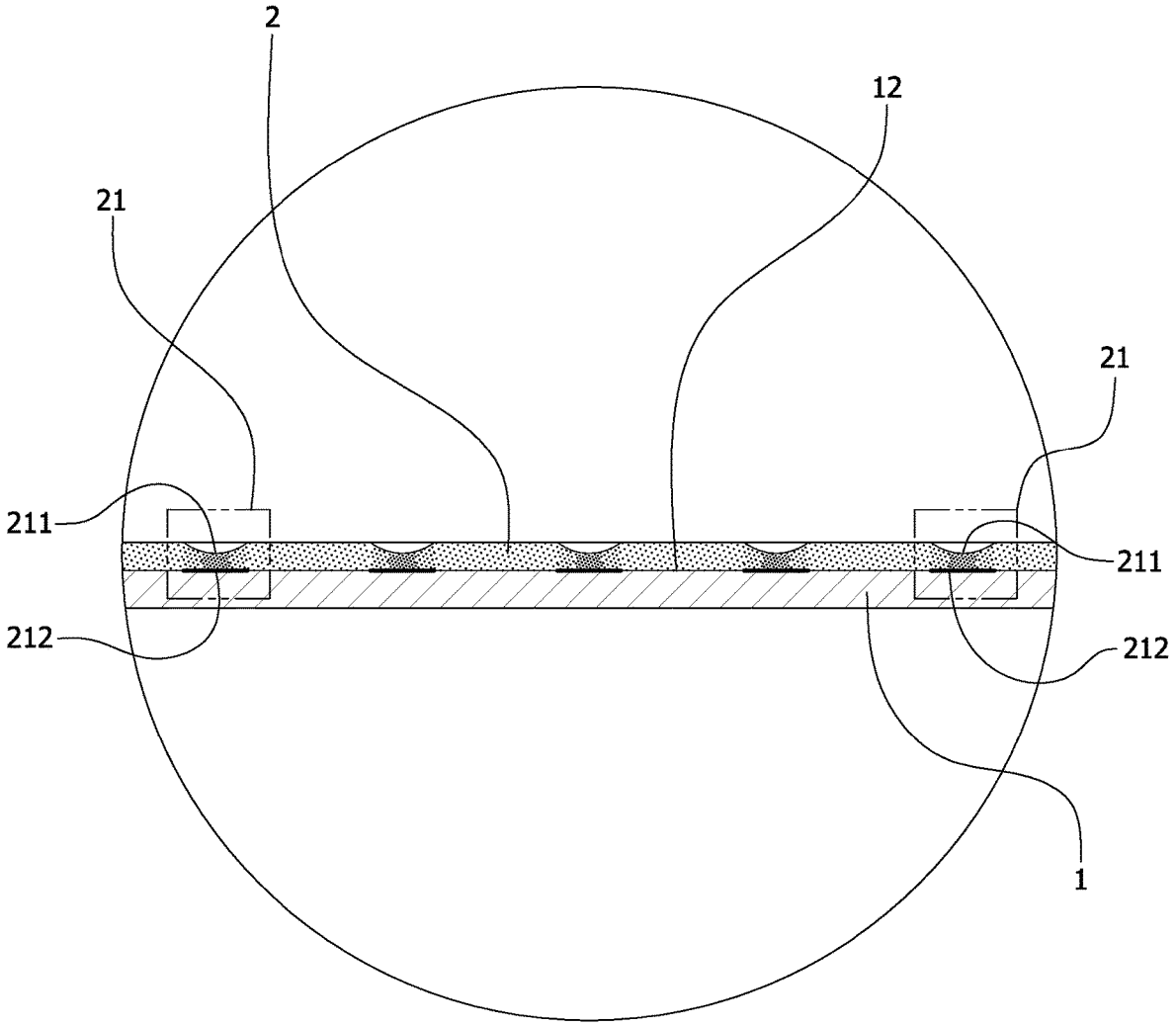
FIG. 5 is a II-II sectional view of FIG. 4.

Referring to FIGS. 2 and 3, the vertical wall of the concave groove portion 13 adjacent to the first abutting face 12, an enhancing rib 16 is configured in a convex ring form. The enhancing rib 16 can enhance the strength of the vertical wall of the concave groove portion 13 adjacent to the first abutting face 12. Thus, when the consumer wants to open the covering film 2 by applying a force on the external side of the top end of the container body 1, the preset break line 15 can break easily. The sufficient strength will not affect the application of a force by the consumer. The tearing is smooth, and the covering film 2 can be smoothly pulled open.

Figure 6:
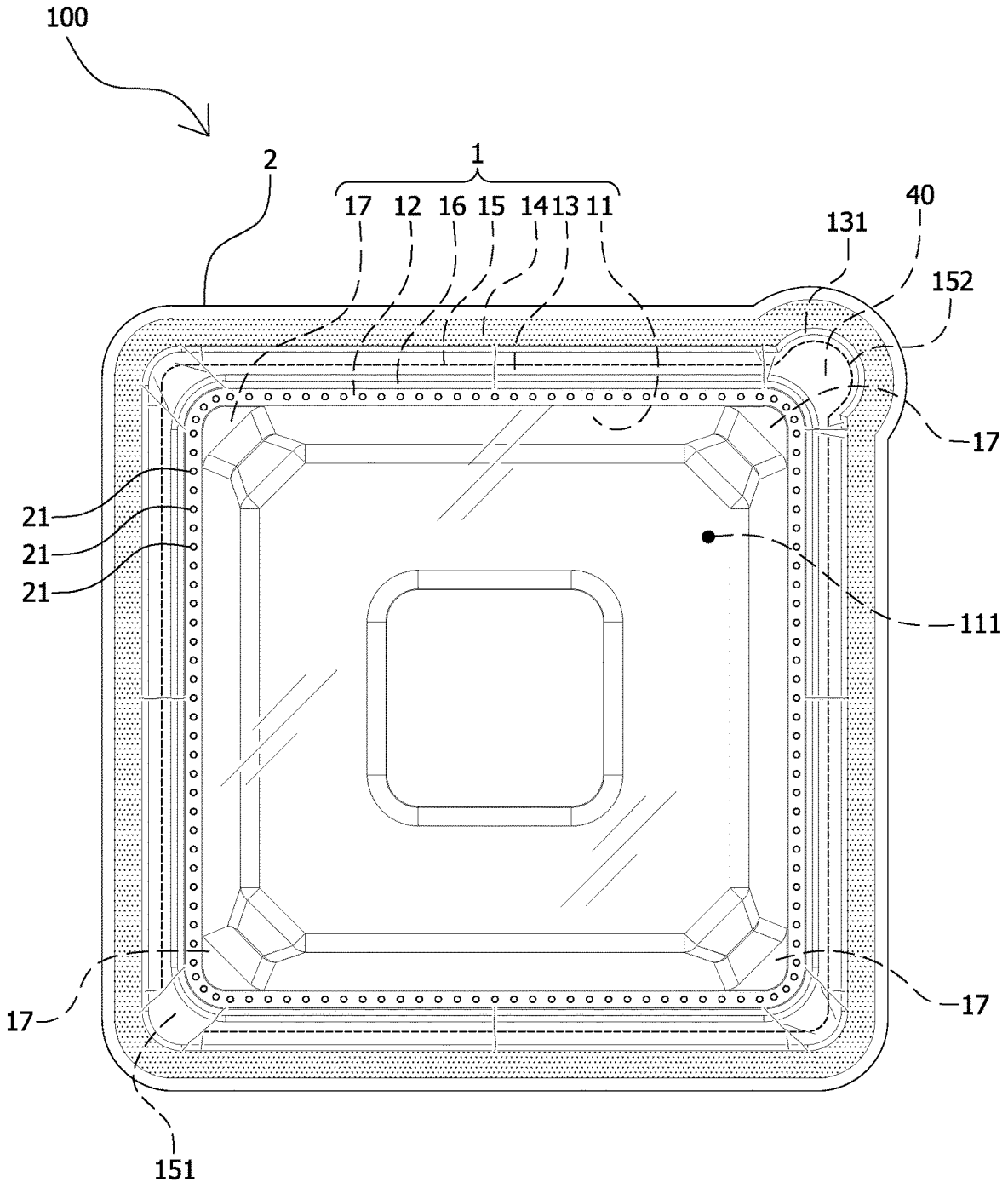
FIG. 6 is a top view of the invention.

Referring to FIGS. 2, 6, the vertical wall of the housing chamber 11 of the container body 1 is configured with concave or convex enhancing portions 17, so as to enhance the structural strength of the container body 1. Thus, the container body 1 can hold more food without deformation. In the case of the embodiment shown in the figure, the enhancing portions 17 are configured on the four corners of the four-sided housing chamber 11, and are recessed from outside toward inside, so as to enhance the structural strength of the container body 1.

Figure 7:
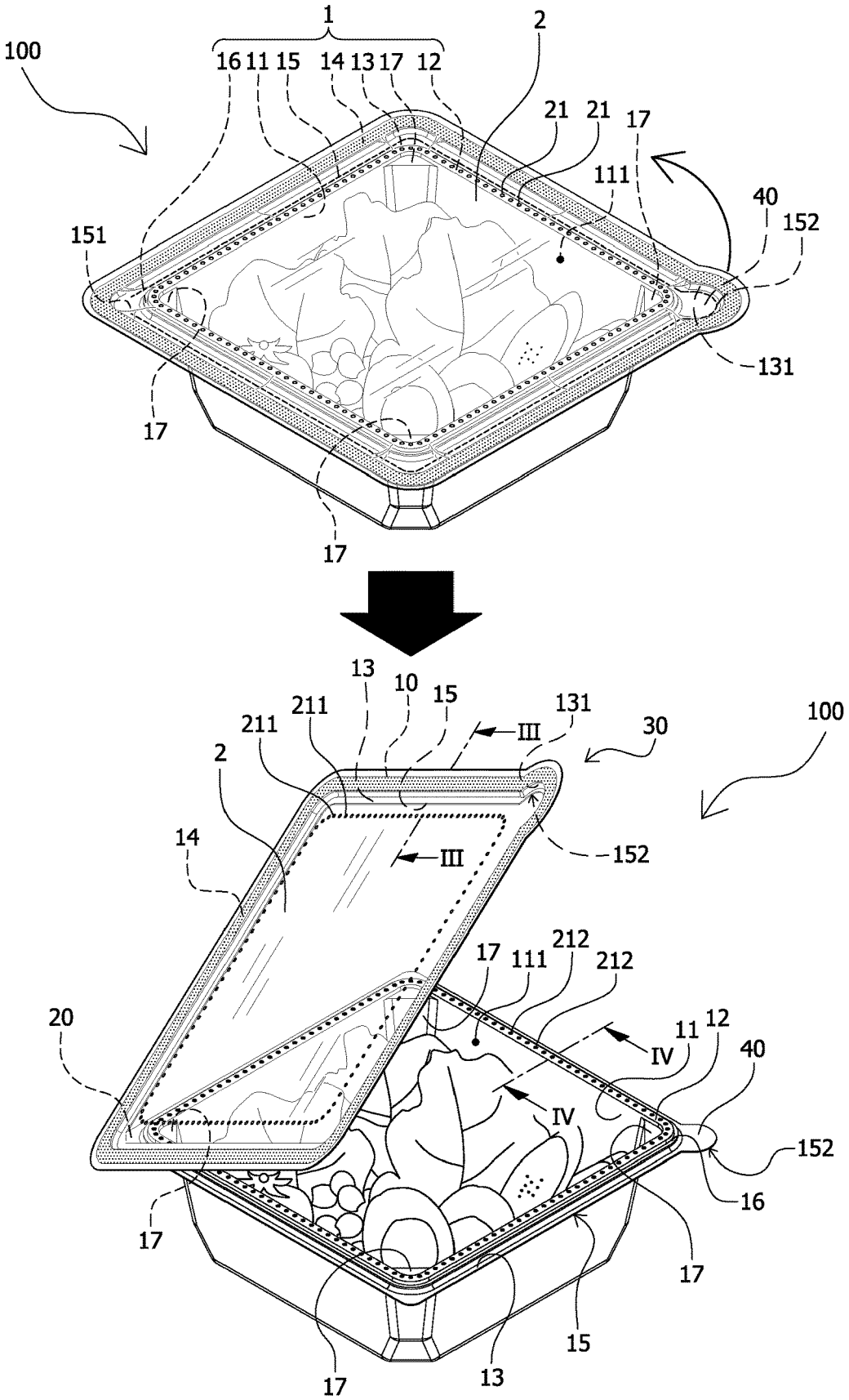
FIG. 7 is an operational view showing the opening of the covering film.
Figure 8:
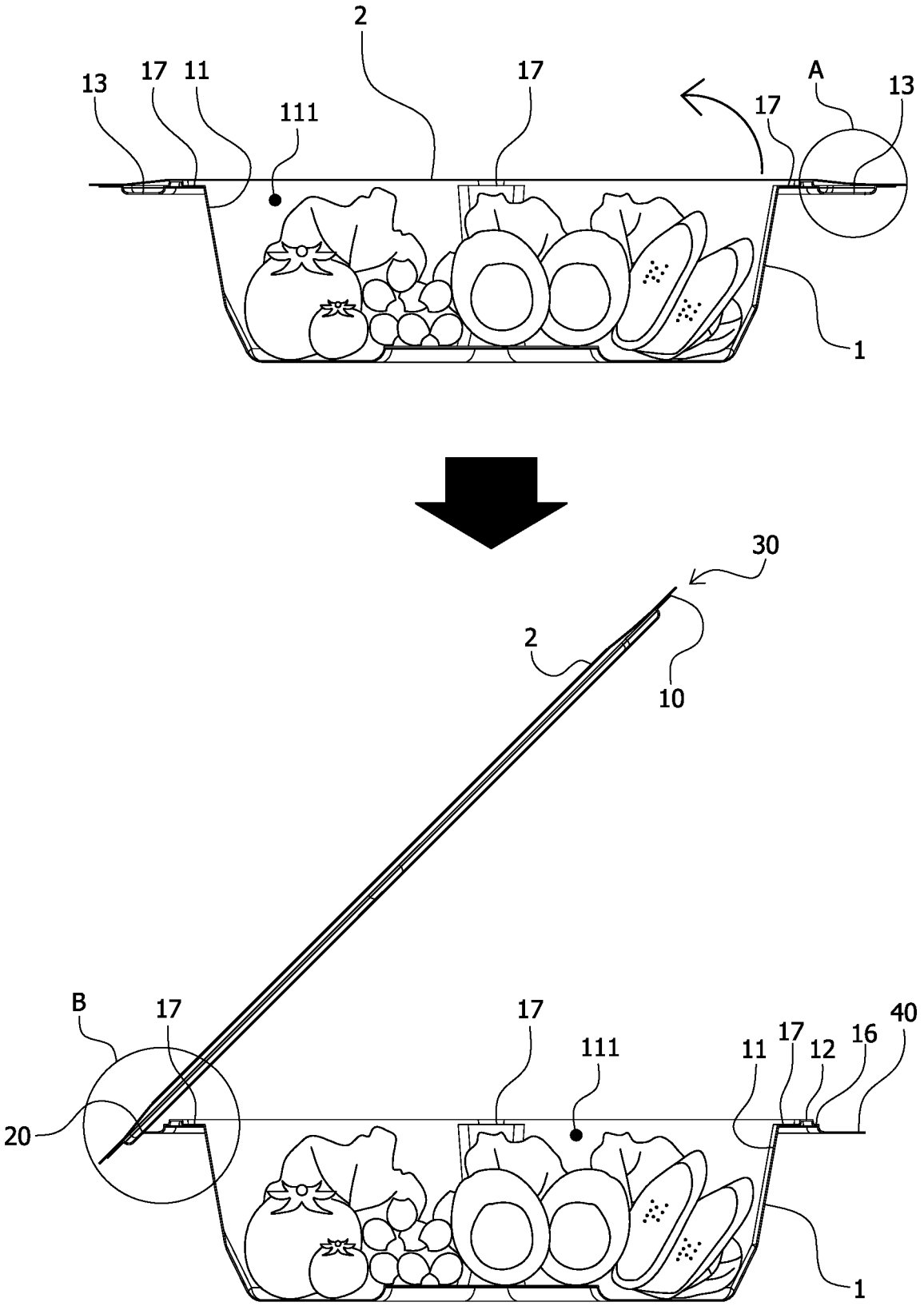
FIG. 8 is a sectional view of FIG. 7 showing the opening of the covering film.
Figure 9:
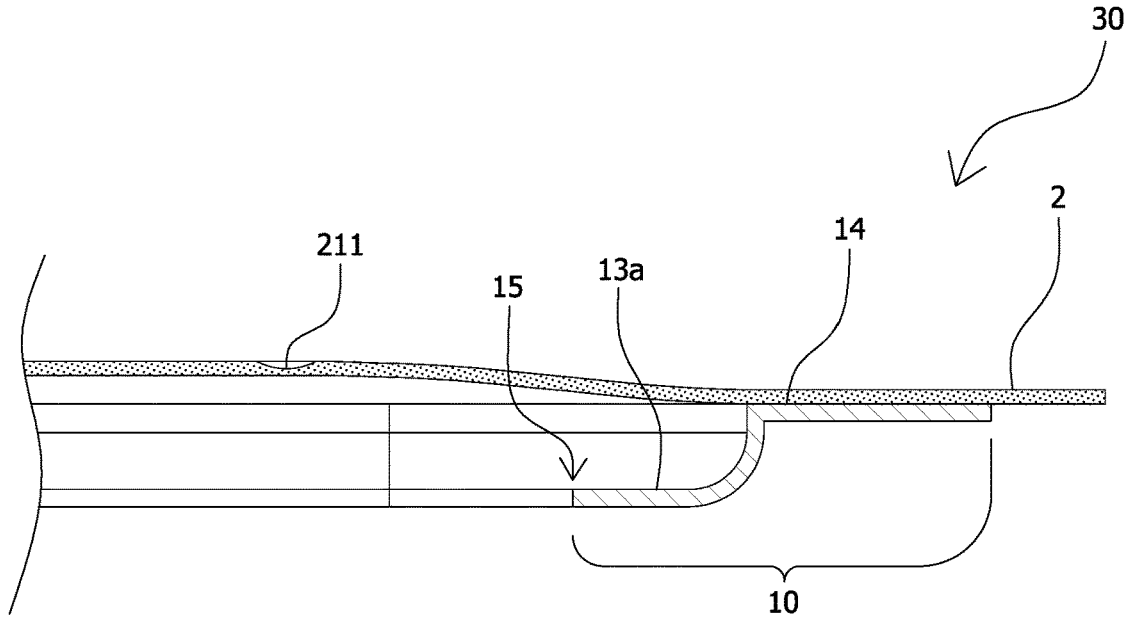
FIG. 9 is a III-III sectional view of the covering plate in FIG. 7.
Figure 10:
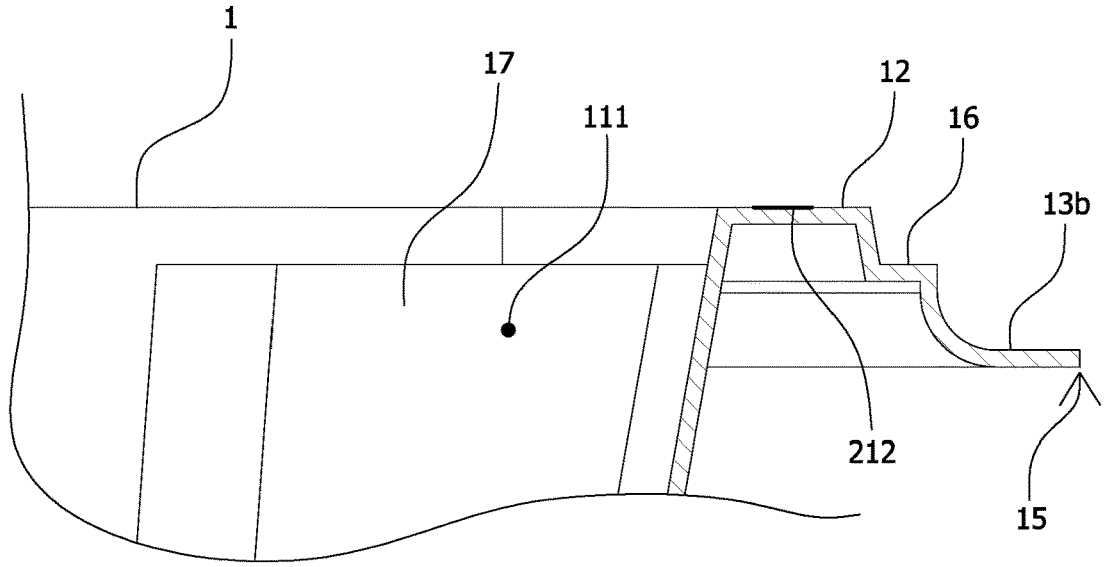
FIG. 10 is a IV-IV sectional view of the container body in FIG. 7.

The operation of the invention is disclosed in FIGS. 7, 8. To open the covering film 2, the consumer needs to pull the outside of the top end of the container body 1 upward, so that the whole preset break line 15 is torn apart. After the breakage, the structure of the frame is as shown in FIG. 9 and FIG. 10. After the preset break line 15 inside the concave groove portion 13 breaks, the micro sealing portion 21 is torn open at the same time, so that the covering film 2 is separated from the first abutting face 12, and will not remain on the container body 1. Only a small dotted trace 212 is remained on the first abutting face 12; at this point, the concave groove portion 13 is broken into two parts, respectively the first concave groove portion 13*a* and the second concave groove portion 13*b*, wherein, the first concave groove portion 13*a* and the second abutting face 14 form a separate ring-shaped frame 10, as shown in FIG. 9, whereas the covering film 2 is still remained on the second abutting face 14, and can be moved along the frame 10; the second concave groove portion 13*b*, the first abutting face 12, and the enhancing rib 16 is remained on the container body 1 to form the last frame, as shown in FIG. 10.

Figure 11:
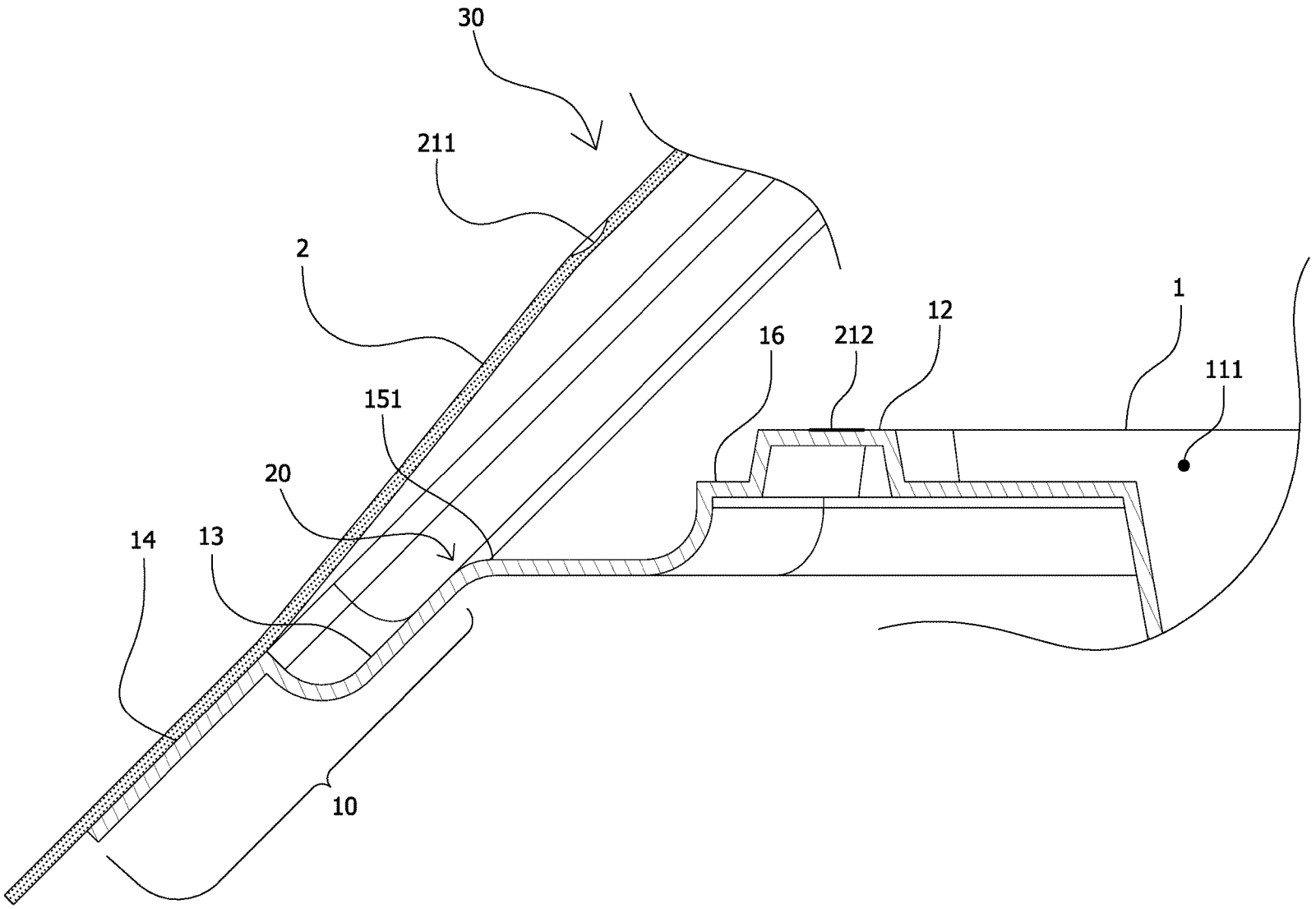
FIG. 11 is an enlarged view of Part B in FIG. 8.

Further referring to FIG. 7, FIG. 11, the notch portion 151 of the container body 1 does not have preset break line 15. Thus, a connecting portion 20 can be formed at this position to enable rotation of the frame 10. The covering film 2 can form a covering plate 30 to open or close the housing chamber 11 along with the movement of the frame 10. The consumer can use this covering plate 30 to open and close the housing space 111 at any time. The function of the aforethe connecting portion 20 is to maintain connection between the covering plate 30 and the container body 1. They are not completely separated. Thus, it is like the container body 1 has its own integral anti-dust cover. This is quite different from the conventional box-shape food containers.

In the above description, the position and length of the notch portion 151 is not limited and can be determined as needed. As for the position, the notch portion 15 in FIG. 7 is configured at a corner position of the square concave groove portion 13. However, it can also be configured at the center position (not shown in the figure) of one side of the four-sided concave groove portion 13. When the concave groove portion 13 is round (see FIGS. 15, 16), the notch portion 151 is configured at a certain position; furthermore, as for length, the notch portion 151 configured at the corner position is shortest, if it is configured on a round concave groove portion 13, it can have bigger length, whereas, if it is configured on either side of a four-sided concave groove portion 13, the length can be further bigger.

Figure 12:
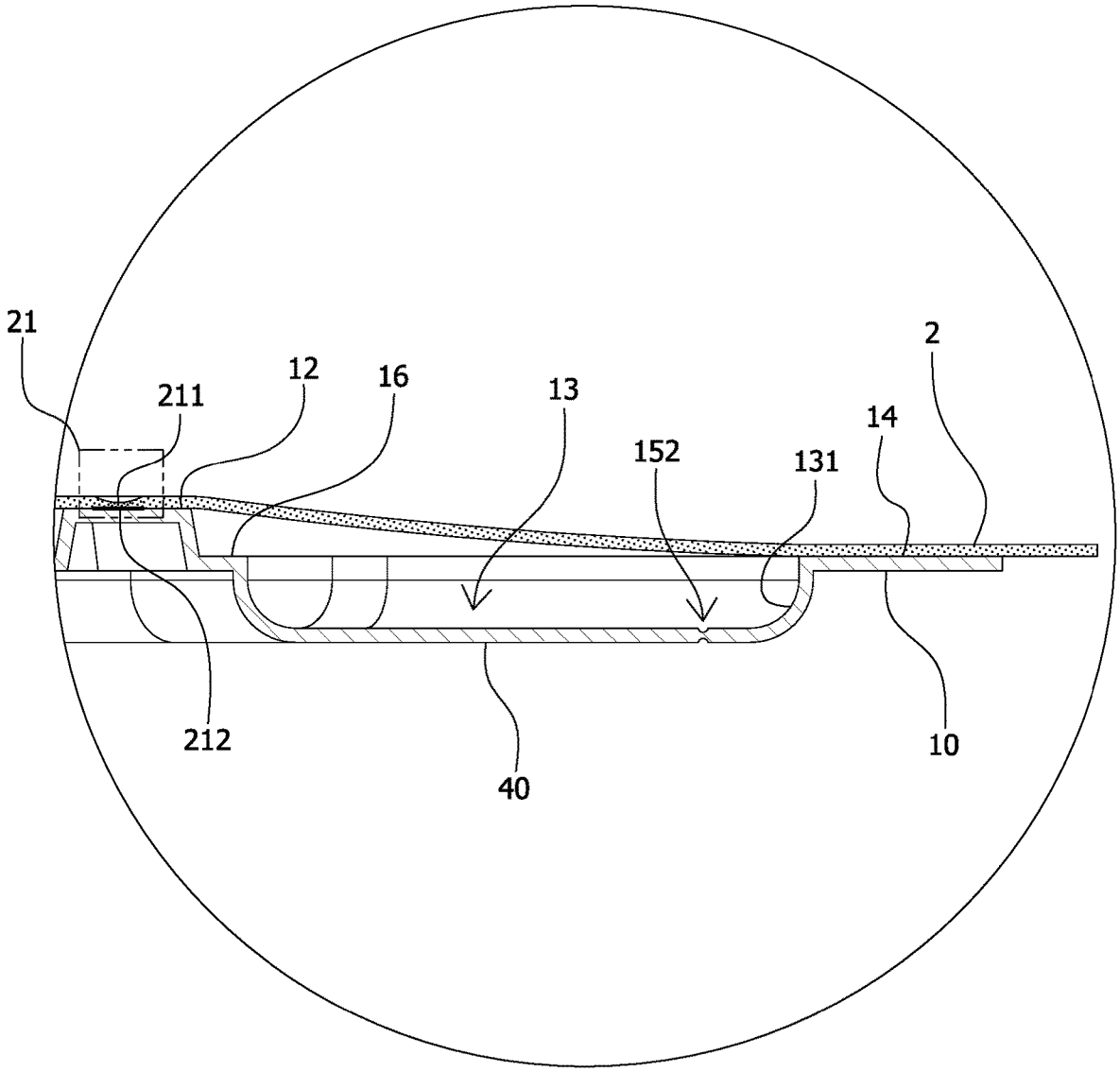
FIG. 12 is an enlarged view of Part A in FIG. 8.

Further referring to FIGS. 7, 12, on the side of the concave groove portion 13 other than the side of the notch portion 151, an outward protruding portion 131 is protruded to facilitate pulling by the consumer; an outward protruding section 152 is formed at the position of the preset break line 15 corresponding to the outward protruding portion 131. The outward protruding section 152 is a tear line connecting the preset break line 15. When the tear line at this position is torn apart, the outward protruding portion 131 can correspondingly formed with a snap plate 40.

Figure 13:
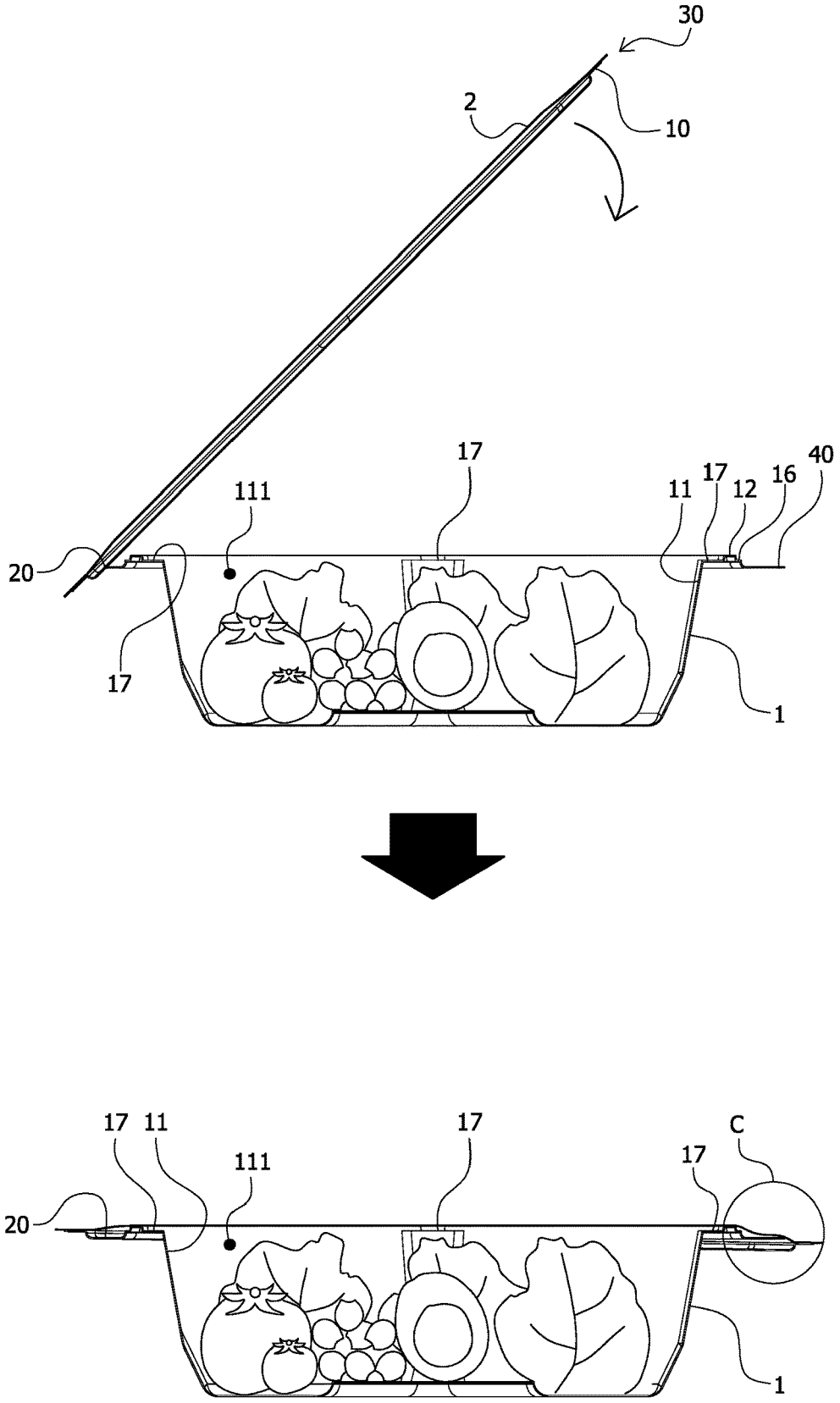
FIG. 13 is a sectional operational view showing the sealing of the covering film.

To store the unfinished food or to facilitate carrying, the consumer needs to turn the covering plate 30 downward toward the housing chamber 11 and cover the housing chamber 11, as shown in FIG. 13, so as to avoid contamination.

Figure 14:
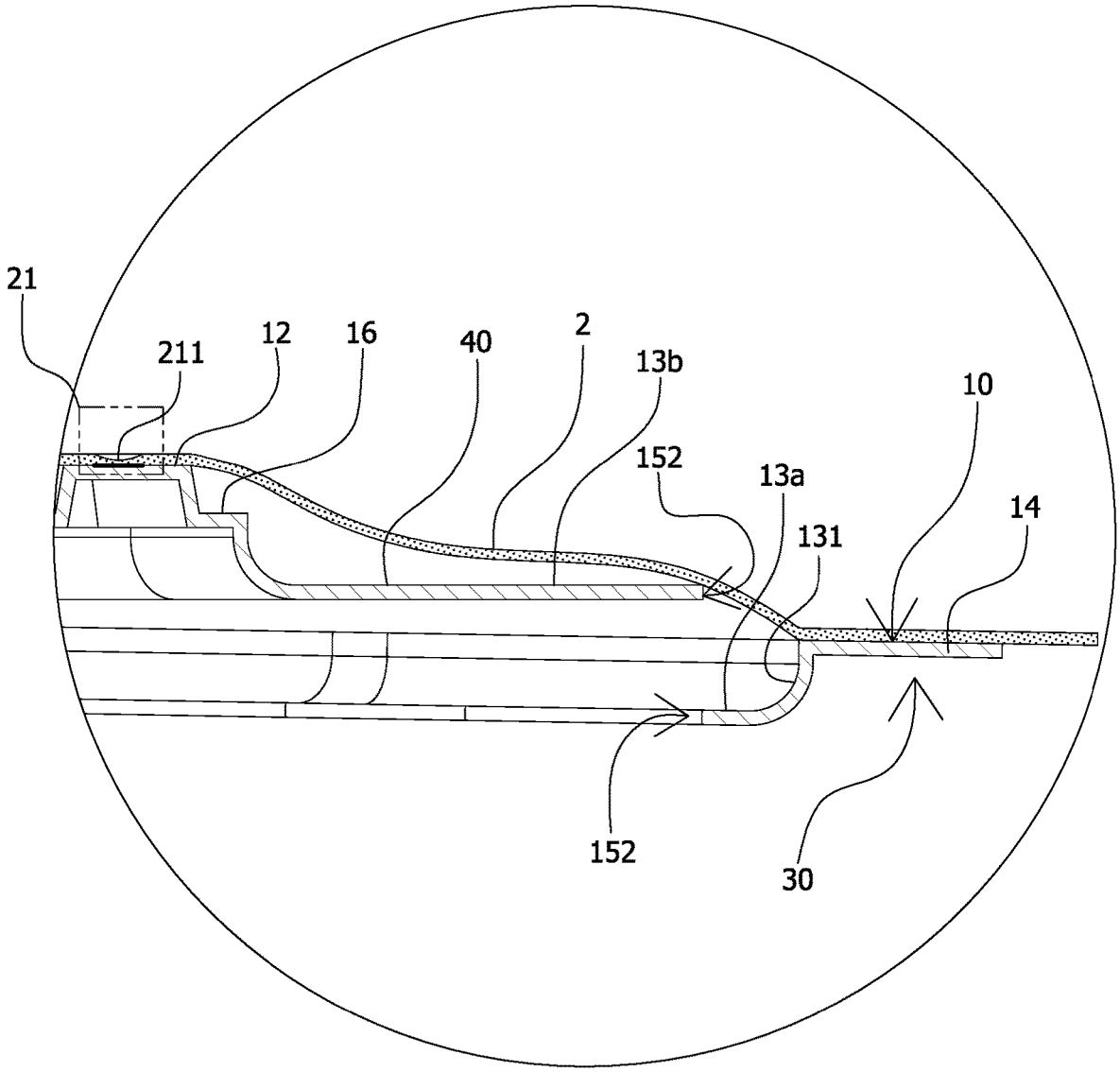
FIG. 14 is an enlarged view of Part C in FIG. 13.

Further referring to FIGS. 13, 14, when the open covering plate 30 is turned downward to cover the container body 1, the housing chamber 11 is covered. Moreover, when the first concave groove portion 13*a* of the frame 10 is pressed downward to be lower than the snap plate 40, if the frame 10 will rise inversely, the first concave groove portion 13*a* will be blocked by the edge of the snap plate 40, so that the covering plate 30 is locked and will not rise. Thus, the covering plate 30 cannot be easily open, and is firmly covered on the housing chamber 11. It will not fall apart unless the consumer pulls the frame 10 and the covering film 2 upward again; The reason of the locking is that, when the frame 10 and the covering film 2 is forcibly pressed downward, the first concave groove portion 13*a* passes through the snap plate 40 and is lower than the snap plate 40, when the force is released, the frame 10 and the covering film 2 themselves will have plastic retraction, and the first concave groove portion 13*a* cannot pass through the snap plate 14 during its rise. The locking is thus formed.

Figure 15:
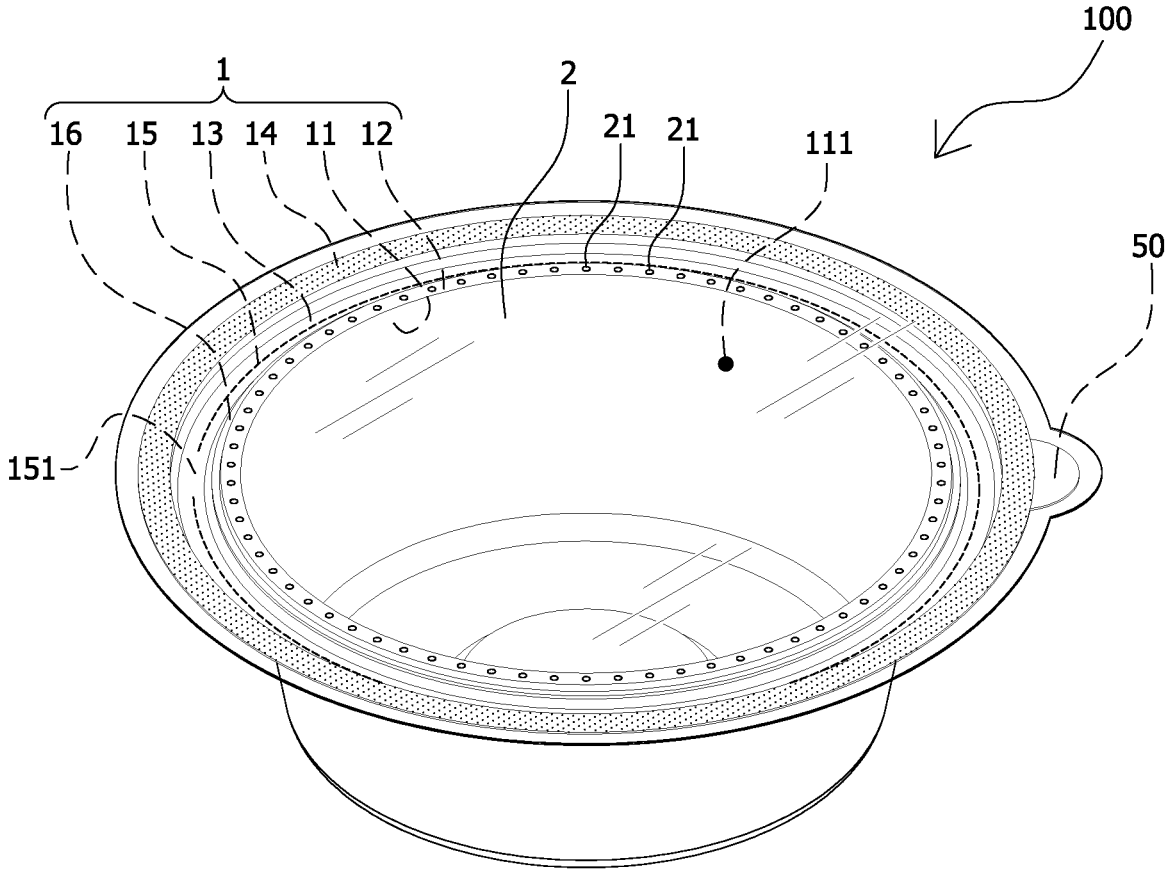
FIG. 15 is a perspective view of another embodiment of the invention.
Figure 16:
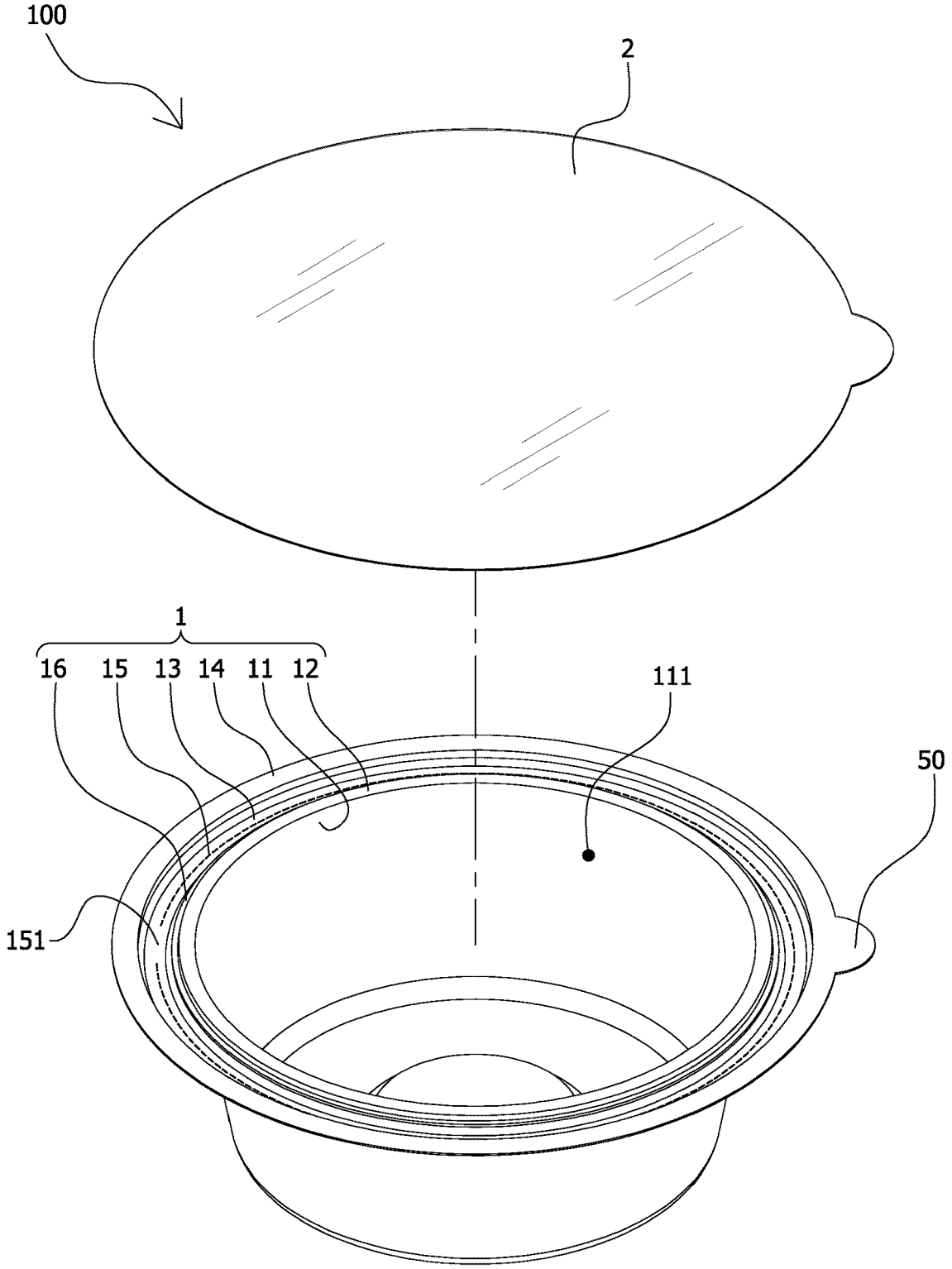
FIG. 16 is an exploded perspective view of the container structure in FIG. 15.

In the end, please refer to FIGS. 15, 16 for another embodiment of the invention. The container structure 100 of the present embodiment is similar to the container structure 100 disclosed in FIG. 1. The difference is that the container structure 1 in FIG. 1 is square, whereas the present embodiment is round. It can also be other shapes. The invention is not limited to the shapes shown in the figures; Moreover, apart from one housing space 111, the housing chamber 11 can be embodied with a plurality of housing spaces 111 (not shown in the figures).

Secondly, the edge on the side of the second abutting face 14 of the container body 1 other than the side of the notch portion 151 is protruded with a pull plate 50. The pull plate 50 can be clamped by the user with two fingers and can be forcibly pulled to open the covering film 2. In this way, the operation can be easier.

Referring back to FIG. 3, the cap height of the first abutting face 12 can be configured in two ways: firstly, it can be higher than the cap height of the second abutting face 14, secondly, it can be equal to the cap height of the second abutting face 14; when the cap height of the first abutting face 12 is higher than the second abutting face 14, the covering film 2 can be opened more easily, and when the covering plate 30 is used to cover the housing chamber 11 again, it can have a better sealing effect, and is therefore suitable for food with a higher fresh-keeping requirement; when the cap height of the first abutting face 12 is equal to the second abutting face 14, the difficulty of production can be reduced, and the container can be applied to a broader range, and is suitable for food with lower fresh-keeping requirement.

I claim:

1. A container structure, comprising a container body (1) and a covering film (2);

wherein the container body (1) is a plastic box, having a housing chamber (11) that includes at least one housing space (111), a top end of the periphery of the housing chamber (11) protrudes outward to form a first abutting face (12), the first abutting face (12) protrudes outward to form a concave groove portion (13), a top end of a periphery of the concave groove portion (13) further protrudes outward to form a second abutting face (14); the first abutting face (12) and the second abutting face (14) both surround the housing chamber (11), with the concave groove portion (13) in between, forming a frame of the container body (1); the first abutting face (12) is an inner ring of the frame, and the second abutting face (14) is an outer ring of the frame; an inner bottom of the concave groove portion (13) has a preset break line (15) configured along the concave groove portion (13), the preset break line (15) is a tear line that can break under an external force, and is configured in a ring, on the other side of the concave groove portion (13), a notch portion (151) without a tear line is configured;

wherein the covering film (2) is a heat-sealing film that covers the housing chamber (11) of the container body (1), a bottom face of the covering film (2) is bonded to the first abutting face (12) and the second abutting face (14) through heat sealing, and does not contact the concave groove portion (13); the covering film (12) is bonded to the second abutting face (14) face to face, and bonded to the first abutting face (12) through dotted sealing, forming an array of micro sealing portions (21), so that a plurality of dotted micro imprints (211) arranged in an array appear on the surface of the covering film (2); after completion of the heat sealing, a dotted bonding between the covering film (2) and the first abutting face (12) is weaker than a facial bonding between the covering film (2) and the second abutting face (14); to open the covering film (2), the user needs to apply a pulling force upon the external edge of the top end of the container body (1), to break the preset break line (15) inside the concave groove portion (13), then pull the covering film (2) upward, to separate the micro imprints (211), so that the covering film (2) is separated from the first abutting face (12), while still bonded with the second abutting face (14), at this point, part of the concave groove portion (13) and the second abutting face (14) will form a separated and independent ring-shaped frame (10); in addition, the notch portion (151) is formed with a connecting portion (20) that enables pivoted rotation of the frame (10), as the covering film (2) is always bonded with the second abutting face (14), a covering plate (30) is maintained on the frame (10) to open and close the housing chamber (11) at any time.

2. The container structure defined in claim 1, wherein, the side of the concave groove portion (13) other than the side of the notch portion (151) is protruded with an outward protruding portion (131); the position of the preset break line (15) corresponding to the outward protruding portion (131) is correspondingly formed with an outward protruding section (152), after breaking of the outward protruding section (152), a snap plate (40) is correspondingly formed at the concave groove portion (13), the snap plate (40) can be used as the outward protruding portion (131) to lock the frame (10).

3. The container structure defined in claim 2, wherein, on a vertical wall of the concave groove portion (13) adjacent to the first abutting face (12), a ring-shaped enhancing rib (16) is provided in a protruding form.

4. The container structure defined in claim 1, wherein, the periphery on the side of the second abutting face (14) other than the side of the notch portion (151) is protruded with a pull plate (50).

5. The container structure defined in claim 4, wherein a cap height of the first abutting face (12) is higher than a cap height of the second abutting face (14).

6. The container structure defined in claim 4, wherein a cap height of the first abutting face (12) is equal to a cap height of the second abutting face (14).

7. The container structure defined in claim 1, wherein a vertical peripheral wall inside the housing chamber (11) of the container body (1) is configured with concave or convex enhancing portions (17).

8. The container structure defined in claim 7, wherein the covering film (2) is made of Cast Polypropylene (CPP).

9. The container structure defined in claim 8, wherein the container body (1) is a plastic container produced through vacuum forming or injection forming.

10. The structure defined in claim 8, wherein the container body (1) is a plastic container produced through injection forming.

* * * * *